US011628917B2

(12) United States Patent
Wilson et al.

(10) Patent No.: US 11,628,917 B2
(45) Date of Patent: Apr. 18, 2023

(54) METHODS AND SYSTEMS FOR CONVEYING, DEPLOYING AND OPERATING SUBSEA ROBOTIC SYSTEMS

(71) Applicant: HonuWorx, Ltd., Aberdeen (GB)

(72) Inventors: Lee Wilson, Aberdeen (GB); Luke Wissmann, Seattle, WA (US); Christopher Carson Sotzing, Old Greenwich, CT (US); Wayne Sherry, Aberdeen (GB)

(73) Assignee: HonuWorx, Ltd., Aberdeen (GB)

( * ) Notice: Subject to any disclaimer, the term of this patent is extended or adjusted under 35 U.S.C. 154(b) by 0 days.

(21) Appl. No.: 17/697,117

(22) Filed: Mar. 17, 2022

(65) Prior Publication Data

US 2022/0204147 A1 Jun. 30, 2022

Related U.S. Application Data

(63) Continuation of application No. 17/370,286, filed on Jul. 8, 2021, now Pat. No. 11,305,853.

(Continued)

(51) Int. Cl.
*B63G 8/00* (2006.01)

(52) U.S. Cl.
CPC ..... *B63G 8/001* (2013.01); *B63G 2008/004* (2013.01); *B63G 2008/007* (2013.01)

(58) Field of Classification Search
CPC .... B63G 8/00; B63G 8/001; B63G 2008/004; B63G 2008/007

(Continued)

(56) References Cited

U.S. PATENT DOCUMENTS

| | | | | |
|---|---|---|---|---|
| 6,167,831 | B1 | 1/2001 | Watt et al. | |
| 9,080,425 | B2 | 7/2015 | Zediker et al. | |
| 11,305,853 | B2 * | 4/2022 | Wilson | B63G 8/001 |

FOREIGN PATENT DOCUMENTS

| | | | |
|---|---|---|---|
| GB | 2365824 | A | 2/2002 |
| WO | 2012013171 | A1 | 2/2012 |

(Continued)

OTHER PUBLICATIONS

An International Search Report and Written Opinion issued by the International Searching Authority dated Oct. 18, 2021 in connection with International application No. PCT/IB2021/056161.

*Primary Examiner* — Lars A Olson
(74) *Attorney, Agent, or Firm* — Baker & McKenzie

(57) ABSTRACT

A submersible system is provided having a submersible launch vessel that sends instructions from a mission controller to deploy one or more deployable systems for one or more underwater operations. The submersible launch vessel is submerged within a waterbody. A submersible power supply powers the submersible launch vessel and the one or more deployable systems. One or more communication devices is in communication with the mission controller, and the mission controller is located in one of a remote or a local location relative to the submersible launch vessel. The one or more deployable systems, via the one or more communication devices coupled to the submersible launch vessel, are remote controlled by the mission controller to execute the one or more underwater operations. Also, information associated with the one or more underwater operations including telemetry data is transmitted to the mission controller from the submersible launch vessel.

31 Claims, 12 Drawing Sheets

Related U.S. Application Data

(60) Provisional application No. 63/053,936, filed on Jul. 20, 2020.

(58) Field of Classification Search
USPC ..... 114/312
See application file for complete search history.

(56) References Cited

FOREIGN PATENT DOCUMENTS

| | | | |
|---|---|---|---|
| WO | 2015049678 | A1 | 4/2015 |
| WO | 2019109083 | A1 | 6/2019 |

* cited by examiner

METHODS AND SYSTEMS FOR CONVEYING, DEPLOYING AND OPERATING SUBSEA ROBOTIC SYSTEMS

CROSS REFERENCE TO RELATED APPLICATIONS

This application is a continuation of U.S. non-provisional application Ser. No. 17/370,286 filed on Jul. 8, 2021, which claims priority to U.S. provisional application No. 63/053,936 filed on Jul. 20, 2020, the entire contents each of which are incorporated herein by reference.

BACKGROUND

Subsea equipment requires enormous procurement and operational costs. Most of these equipment combust huge amounts of fossil fuels for power needed for their operations. As a result, the carbon footprint left behind by such equipment overtime undesirably contributes to an already increasing global warming problem. Furthermore, some of these equipment require onsite personnel to operate them. Such personnel are often subjected to health and safety risks associated with working in marine environments. Additionally, mobilization, demobilization, and deployment of such equipment take a significant amount of time (e.g., weeks, months) which could lead to delays in project execution. In addition, some of these equipment are not designed to be versatile enough to operate in different oceanic states and depths. Moreover, lifting and deploying equipment and other subsea objects on/underwater is often fraught with many challenges. For example, the subsea equipment and other subsea objects may be exposed to damage risks due to the air-water interface these objects traverse during such lifting operations. Furthermore, the resultant complexity, weight, and costs of both the lifting equipment and the lifted equipment/objects requires optimizations that enhance subsea lifting operations.

BRIEF SUMMARY

According to one aspect of the subject matter described in this disclosure, a method of operating a submersible system is provided. The method comprises the following: receiving instructions from a mission controller via a submersible launch vessel to deploy one or more deployable systems of the submersible launch vessel for one or more underwater operations, wherein: the submersible launch vessel is submerged within a waterbody, the submersible launch vessel includes a submersible power supply that powers the submersible launch vessel and the one or more deployable systems; and the submersible launch vessel includes one or more communication devices in communication with the mission controller, the mission controller is located in one of a remote or a local location relative to the submersible launch vessel; remote controlling, via the one or more communication devices coupled to the submersible launch vessel, the one or more deployable systems by the mission controller to execute the one or more underwater operations; and transmitting information associated with the one or more underwater operations including telemetry data to the mission controller from the submersible launch vessel.

According to another aspect of the subject matter described in this disclosure, a submersible system is provided. The submersible system includes a submersible launch vessel that sends instructions from a mission controller to deploy one or more deployable systems for one or more underwater operations. The submersible launch vessel is submerged within a waterbody. A submersible power supply powers the submersible launch vessel and the one or more deployable systems. One or more communication devices is in communication with the mission controller, and the mission controller is located in one of a remote or a local location relative to the submersible launch vessel. The one or more deployable systems, via the one or more communication devices coupled to the submersible launch vessel, are remote controlled by the mission controller to execute the one or more underwater operations. Also, information associated with the one or more underwater operations including telemetry data is transmitted to the mission controller from the submersible launch vessel.

According to another aspect of the subject matter described in this disclosure, a submersible system is provided. The submersible system includes a submersible launch vessel that sends instructions from a mission controller to deploy one or more deployable systems for one or more underwater operations. The submersible launch vessel is submerged within a waterbody. A submersible power supply powers the submersible launch vessel and the one or more deployable systems. One or more communication devices is in communication with the mission controller, and the mission controller is located in one of a remote or a local location relative to the submersible launch vessel. The submersible launch vessel and the one or more deployable systems use machine learning to optimize mission execution to ensure reactive and efficient operations.

Additional features and advantages of the present disclosure are described in, and will be apparent from, the detailed description of this disclosure.

BRIEF DESCRIPTION OF THE DRAWINGS

The disclosure is illustrated by way of example, and not by way of limitation, in the figures of the accompanying drawings in which like reference numerals are used to refer to similar elements. It is emphasized that various features may not be drawn to scale and the dimensions of various features may be arbitrarily increased or reduced for clarity of discussion.

DETAILED DESCRIPTION

Figure 1:
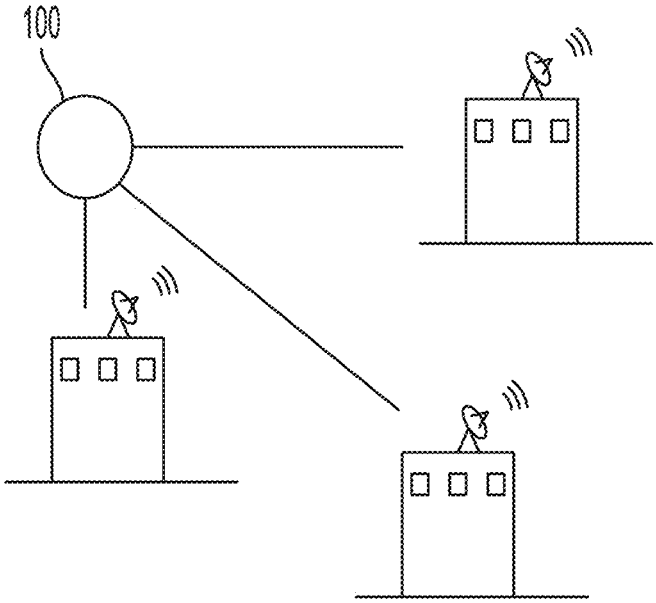
FIG. 1 is a schematic diagram illustrating a plurality of onshore control and supervision locations for managing subsea operations, in accordance with some embodiments.

The figures and descriptions provided herein may have been simplified to illustrate aspects that are relevant for a clear understanding of the herein described devices, systems, and methods, while eliminating, for the purpose of clarity, other aspects that may be found in typical similar devices, systems, and methods. Those of ordinary skill may recognize that other elements and/or operations may be desirable and/or necessary to implement the devices, systems, and methods described herein. But because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

The terminology used herein is for the purpose of describing particular example embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another element, component, region, layer or section. That is, terms such as "first," "second," and other numerical terms, when used herein, do not imply a sequence or order unless clearly indicated by the context.

The present disclosure provides systems and methods that include operating a submersible launch vessel having a large onboard power system suited for subsea robots (e.g., remote operated vehicles (ROVs) and autonomous underwater vehicles (AUVs)) and long term operation. The system includes an onshore control and supervision center for remotely managing subsea operations. In addition, the system provides for a shared autonomy between the submersible launch vessel and a subsea robot associated with the submersible launch vessel. The system further allows remote actors such as technicians, engineers, research scientists and project managers to be distributed across multiple geographical locations such that each onshore actor is able to remotely access and operate the subsea robot and/or other machinery and/or other functionality associated with the submersible launch vessel.

In some implementations, the methods and systems may include the use of a submersible launch vessel in combination with an onshore control system that supervises subsea operations. The submersible launch vessel may include one or more subsea robots. In some cases, the methods and systems leverage a shared autonomy between a subsea robot and the submersible launch vessel for optimal performance of subsea operations.

In some embodiments, one or remote onshore actors (e.g., technicians, project managers and research scientists) may be distributed across a plurality of geographical locations such that the one or more onshore actors can remotely communicate (e.g., via wired or wireless links) with or otherwise operate a subsea robot operating in a subsea environment. There may be variable levels of autonomy between the launch vessel, robots and the human operator(s) e.g. sometimes the robot control may be "live" with direct human control (like a traditional car) and in some cases the robots will be highly automated with the human operator supervising (like an autopilot mode). The threshold between human and autonomous control may be able to change based on the task requirements.

FIG. 1 shows a number of onshore control and supervision locations 100 for managing subsea operations, according to some embodiments. The control and supervision locations 100 may be located at a location that is remote relative to a given submersible launch vessel. The plurality of onshore control and supervision locations 100 may be a single structure in one geographical location or distributed across the same geographical location or distributed across multiple geographical locations depending on the embodiment. In some cases, control and supervision locations 100 may be located virtually—for example, a mission controller may be a software program located in a cloud.

In some instances, each onshore control and supervision location 100 may include a plurality of computing devices coupled to one or more communication devices (e.g., wired and/or wireless communication devices) in communication with the submersible launch vessel.

In some embodiments, the one or more communication devices may include satellite or wireless communication devices that are electronically enhanced using signal processing that mitigate against latency, multipath interference, and other fading issues associated with signals (e.g., data) being transmitted between the onshore control and supervision locations 100 and the submersible launch vessel.

Furthermore, since the onshore control and supervision locations 100 may be distributed across multiple locations, operations of the submersible launch vessel and/or its robots may be independently and/or simultaneously coordinated or supervised from multiple locations with varying levels of human/machine intervention from control and supervision locations 100 at different stages of a given mission (e.g., lowering/lifting operations, underwater operations, subsea operations, etc.). Thus, a "mission controller" at a given control and supervision location 100 may, at any given time, be monitoring, controlling, or otherwise supervising the submersible launch vessel and/or the subsea robots contained within the submersible launch vessel. It is to be appreciated that according to the principles of the present disclosure, the systems disclosed herein are more efficient in carrying out offshore (including subsea) operations involving subsea robots as vessels with human operators positioned nearby such subsea robots are not needed in the systems disclosed herein.

In some embodiments, the mission controller may be a person, a machine, or through the use of a variable autonomy system a combination thereof, in one or more onshore control and supervision locations 100.

Figure 2A:
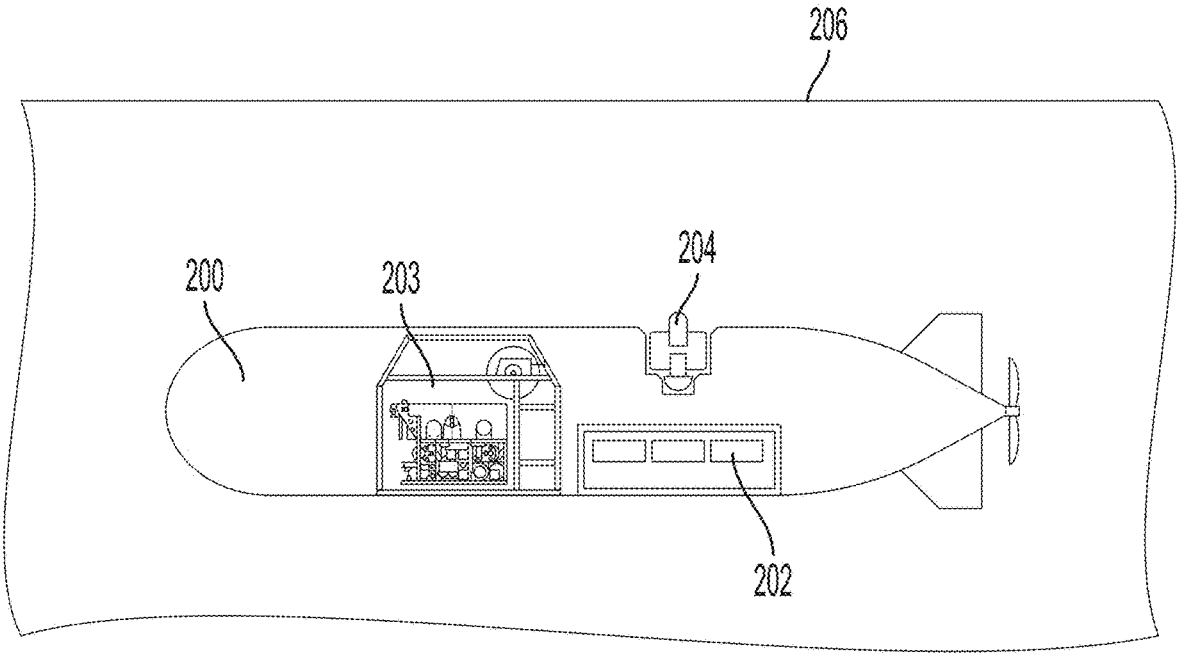
FIG. 2A-2B are schematic diagrams illustrating submersible launch vessels housing a power source and a subsea robot, in accordance with some embodiments.
Figure 2B:
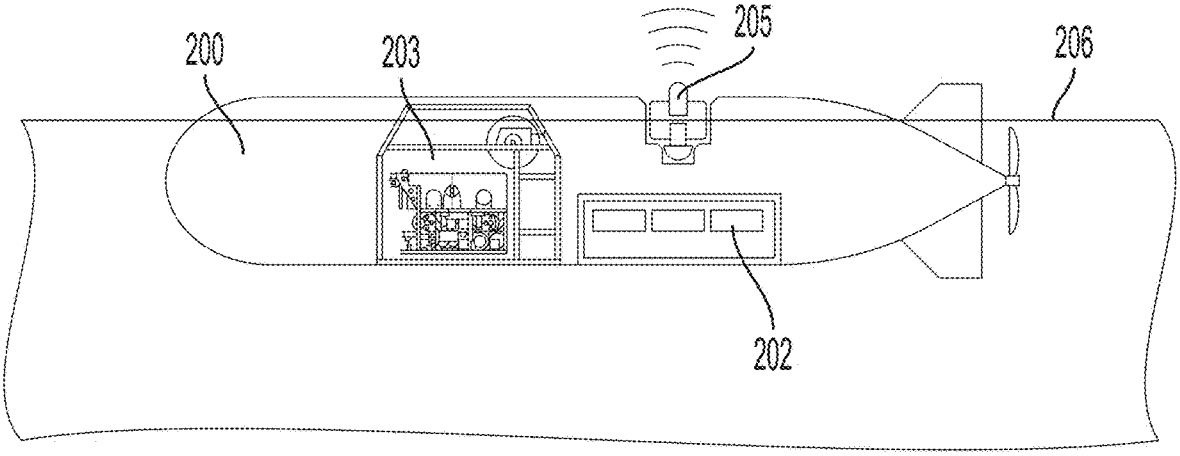

FIG. 2A-2B are schematic diagrams illustrating a submersible launch vessel 200 housing a power source 202 (submersible power source) and a subsea robot (e.g., AUVs and/or ROVs) 203, in accordance with some embodiments. The subsea robot 203 may be housed within an enclosure of the submersible launch vessel 200. The interface for the subsea robot 203 may be modular. Moreover, the launch vessel 200 may be used to quickly deploy different types of subsea robots. When the submersible launch vessel 200 is submerged below the water surface 206, the submersible launch vessel 200 may include a through-water communication device 204 (as shown in FIG. 2A) in communication with one or more over-the-air communication devices communicatively coupled to the one or more onshore control and supervision locations 100. When the submersible launch vessel 200 is at the water surface 206, the submersible launch vessel 200 may include an over-the-air communication device 205 (as shown in FIG. 2B) in communication with one or more over-the-air communication devices communicatively coupled to the one or more onshore control and supervision locations 100.

In some embodiments, the power source 202 may include a submersible power source that supplies power to various equipment and systems of the submersible launch vessel 200. In some embodiments, the power source 202 may be a submersible power source dedicated to providing power for the operation of one or more robots 203 of the submersible launch vessel 200. In some embodiments, the power source 202 may also recharge the through-water communication device 204 (or over-the-air communication device 205) which has its own battery power to keep the width of a tether small that connects the through-water communication device (or over-the-air communication device) to the submersible launch vessel 200 as a tether having a small width reduces drag. The power source 202 may include one or more battery banks that are charged before submersing the submersible launch vessel 200 into water (e.g., oceans, seas, lakes, rivers, etc.).

In some embodiments, the battery banks may be charged as the submersible launch vessel 200 is being driven by a secondary power source (e.g., power generators). In some embodiments, the power source 202 may store energy from one or more renewable sources (wind, solar, or wave energy) when the submersible launch vessel 200 is docked on the surface of a given waterbody (e.g., oceans, seas, lakes, rivers, reservoirs, or the like). In some embodiments, the power source 202 may include a power generator that can leverage renewable energies to generate power for operating the submersible launch vessel 200 and other equipment housed within it. It is appreciated that the power source 202 may not require the combustion of large quantities of fossil fuels like other systems thus minimizing the exposure of the environment to greenhouse gases.

In some embodiments, the power source 202 may be used to charge other power systems (i.e. on the robots which may in turn be battery powered). In this regard, the submersible launch vessel 200 autonomously manages the distribution and smart application of power, using knowledge of the available energy and predictive load modelling in order to execute a mission in the most power effective sequence. The algorithm may be enhanced using machine learning and digital twins.

Figure 3:
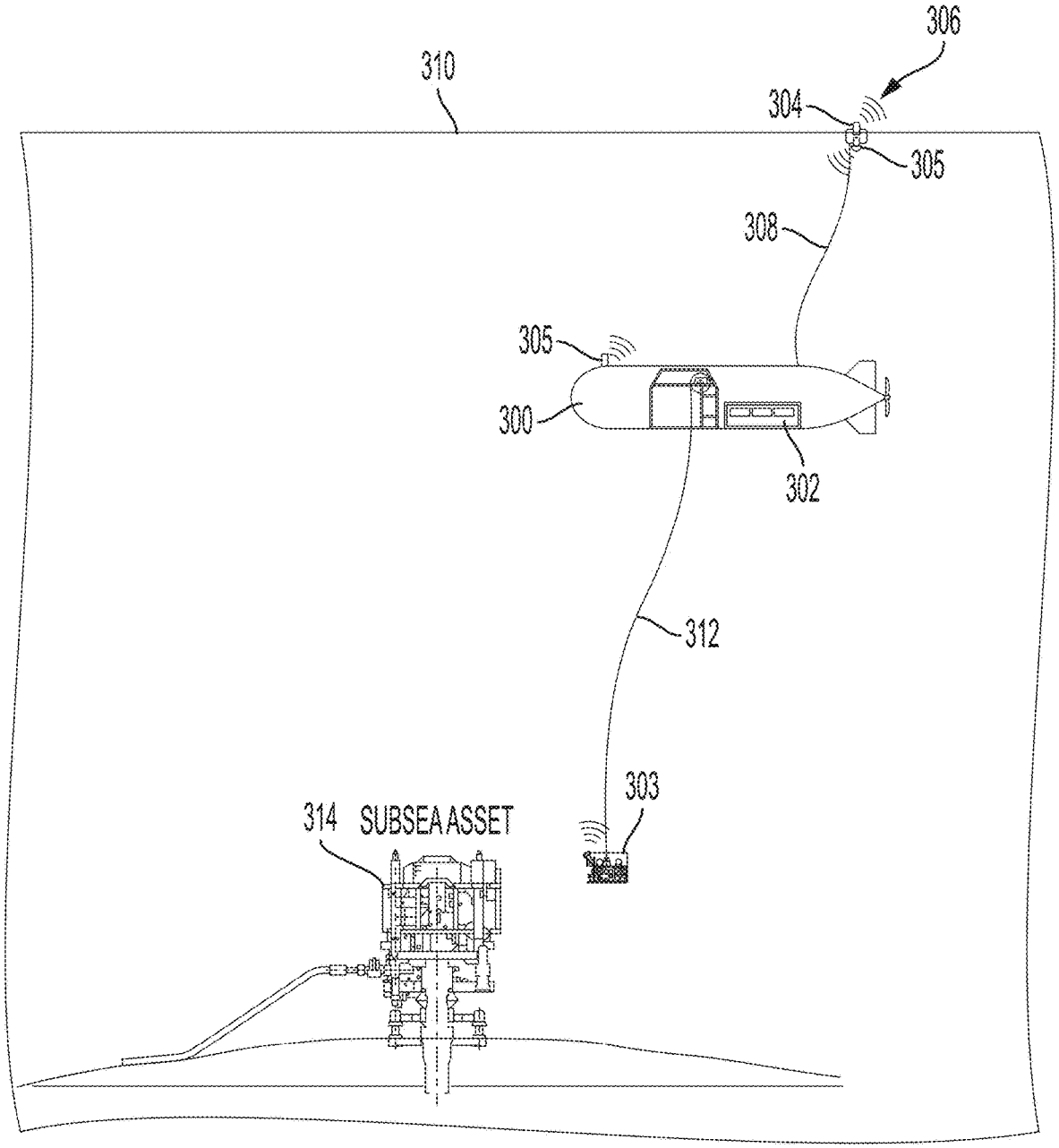
FIG. 3 is a schematic diagram illustrating an over-the-air communication device of a submersible launch vessel staying afloat when the submersible launch vessel is submerged, in accordance with some embodiments.

FIG. 3 is a schematic diagram illustrating an over-the-air communication device 304 and a through-water communication system 305 staying afloat when submersible launch vessel 300 is submerged, in accordance with some embodiments. In particular, the over-the-air communication device 304 of the submersible launch vessel 300 may stay afloat when the submersible launch vessel 300 is submerged in order to maintain over-the-air communication with the one or more onshore control and supervision locations 100. In this instance, the over-the-air communication device 304 of the submersible launch vessel 300 may be attached to or otherwise embedded within a floatation device 306 (e.g., a buoy). The floatation device 306 may be operably coupled to the submersible launch vessel 300 via, a wired link 308, which extends to various depths (e.g., 5-10 meters, 10-20 meters, 20-40 meters, 40-100 meters, etc.) of a waterbody 310 within which the submersible launch vessel 300 is submerged.

The subsea robot 303 may include a through-water communication device in communication with another through-water communication device 305 operably coupled to the submersible launch vessel 300 as shown in FIG. 3. In some embodiments, the floatation device 306 may include the through-water communication device 305.

For example, the submersible launch vessel 300 may receive one or more instructions from an onshore actor via the over-the-air communication device 304 and relay the one or more instructions to the subsea robot 303 via the through-water communication device 305. It is appreciated that the subsea robot 303 may be coupled to the submersible launch vessel 300 using a wired connection that supplies power to and/or communications to the robot 303. In some embodiment, the subsea robot 303 may be coupled to the submersible launch vessel 300 using a wireless tether connection that supplies communications to the robot 303, where communication device 305 could be on a buoy, or a submersible platform, or both.

In some embodiments, wired connection 312 may also facilitate data communication or data relay from the submersible launch vessel 300 to robot 303. The wired connection 312 may also supply continuous power and/or communications to the subsea robot 303.

In some embodiments, the robot 303 may communicate wirelessly with the submersible launch vessel 300. In some implementations, it is appreciated that the communication devices on the subsea robot 303 and the submersible launch vessel 300 may also employ signal processing technology (e.g., intelligent robotic control applications) that mitigate against latency, multipath interference, and other fading issues associated with signals (e.g., data) being transmitted between the subsea robot 303 and the submersible launch vessel 300.

In some implementations, the communication devices on the subsea robot 303 may transmit data associated with autonomous operations being executed by the subsea robot 303 to the submersible launch vessel 300. Similarly, the communication devices of the submersible launch vessel 300 may also transmit data associated with autonomous operations being executed by the submersible launch vessel 300 and/or the subsea robot 303 to one or more control and supervision locations 100 of FIG. 1.

Examples of information transmitted between the subsea robot 303 and launch vessel 300 may include mission status (to synchronize a shared mission plan), vehicle position, perceived world information (as recorded from perception sensors like cameras and sonars to synchronize a shared world model) and direct commands to request behavior (redirect, stop, start, pause, etc.). The aforementioned information may also be transmitted to the cloud to allow operators a full and up-to-date picture of the operation. Other embodiments where the subsea robot 303 directly transmits data associated with autonomous, semi-autonomous, or manual subsea operations to one or more control and supervision locations 100 are also contemplated.

In some embodiments, the subsea robot 303 may be docked at a docking station of the submersible launch vessel so it can be charged prior to being deployed (e.g., while being conveyed and/or transported) to execute one or more subsea tasks. In such cases, the subsea robot 303 may include onboard batteries or energy packs that store energy from the large power source. The onboard batteries of the subsea robot 303 may power the robot for up to about 8 hours, or up to about 10 hours, or up to about 15 hours, or up to about 20 hours, or up to and beyond 24 hours, depending on the embodiment.

It should be noted that the submersible launch vessel 300 may include features other than those described above. In some embodiments, the submersible launch vessel 300 may include a mooring feature that allows for the mooring or securing of surface and/or assets (e.g., subsea assets) to forestall free movement of subsea assets.

In some embodiments, the submersible launch vessel 300 may include two or more similar and/or dissimilar subsea robots 303. In some embodiments, the submersible launch vessel 300 may be itself a robot. In some embodiments, two or more similar and/or dissimilar subsea robots 303, including the submersible launch vessel 300, may be dynamically controlled or otherwise coordinated in a collaborative fashion to optimize usage of large power source 302, and thereby enhance the efficiency of subsea/underwater tasks.

In some embodiments, a mission controller may control or supervise a coordinated dynamic motion between one or more collaborating robots including the submersible launch vessel 300 in order to successfully execute one or more subsea operations at a subsea asset 314. In some embodiments, the mission controller may also control/maintain the relative positions of the submersible launch vessel 300 and one or more robots 303 of the submersible launch vessel to safely and efficiently carry out one or more subsea tasks at subsea asset 314. In some embodiments, the submersible launch vessel 300 may control the subsea robot 303 for deployment and then hand off control to a control center.

In some embodiments, the subsea robot 303 may be affixed to the submersible launch vessel 300 with a docking interface and/or a tether management system as needed. The submersible launch vessel 300 may navigate itself toward a given worksite (e.g., a location at a top surface of a waterbody within which underwater operations are to be executed) using an onboard propulsion and navigation system remotely controlled by an onshore actor or autonomously by an onboard software intelligence system.

In some embodiments, the submersible launch vessel 300 may be towed to the worksite by a small vessel of opportunity (e.g., fishing vessels, charter vessels, deck barges, and other types of boats). As previously noted, operators (e.g., remote actors and/or personnel of other floating control stations remotely located from the submersible launch vessel 300) of the submersible launch vessel 300 and its equipment may be located in multiple onshore and offshore geolocations, and may be connected to the over-the-air communication device of the submersible launch vessel 300 via satellite and/or via cellular communications links.

Operation

Figure 4:
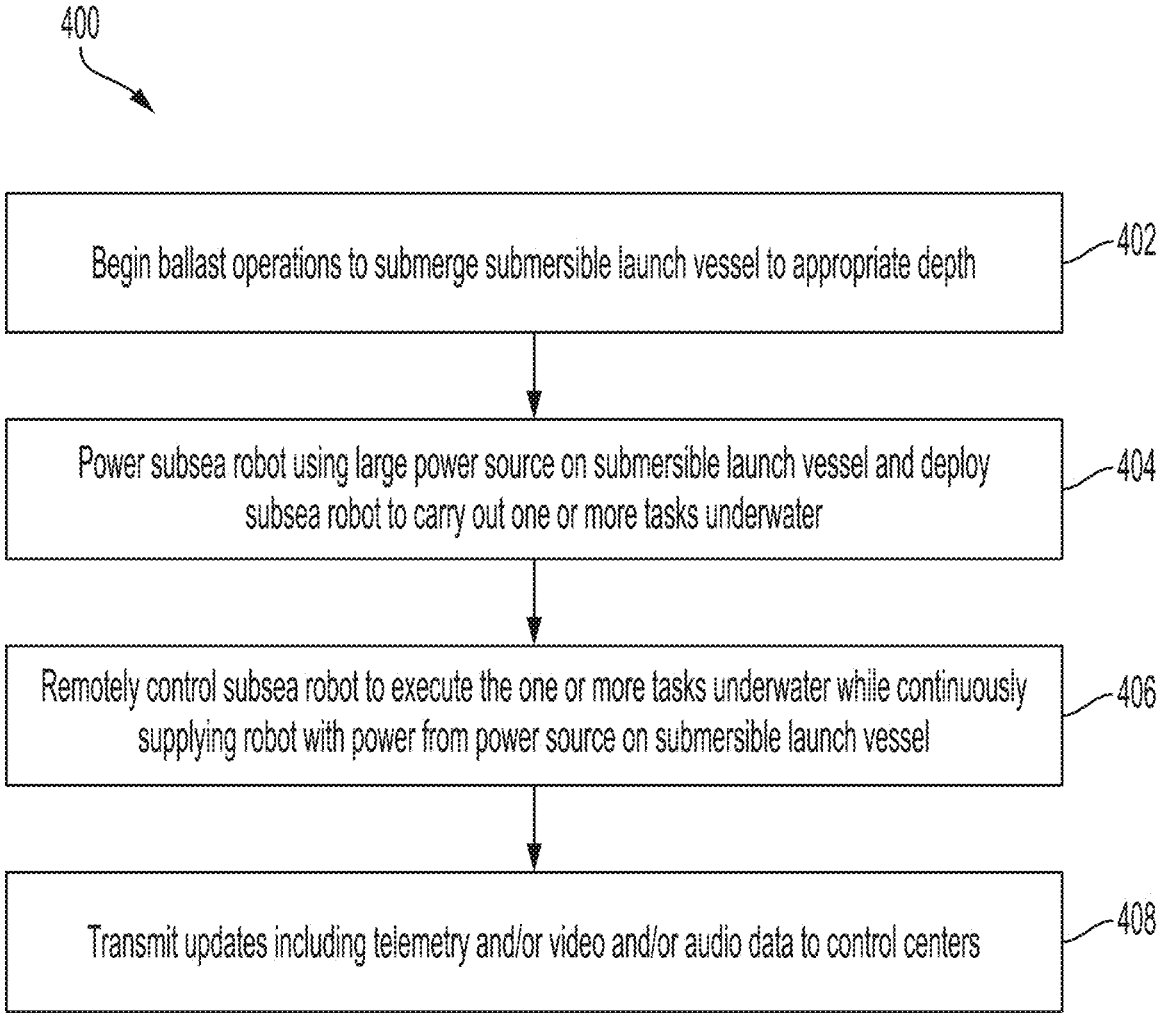
FIG. 4 is a flowgraph illustrating the operations of a submersible launch vessel, in accordance with some embodiments.

FIG. 4 is a flowgraph 400 illustrating the operations of a submersible launch vessel, in accordance with some embodiments. In some embodiments, the submersible launch vessel may submerge just outside the harbor and navigate to the worksite submerged. In other embodiments, the submersible launch vessel may navigate to the worksite on the water surface, and when the worksite is reached, the submersible launch vessel may be instructed (e.g., by a remote actor) to begin ballast operations that cause it to submerge, as shown at block 402. In some embodiments, the submersible launch vessel may be the submersible launch vessels described in FIGS. 2-3. The submersible launch vessel may be submerged to any appropriate depth within the waterbody for the deployment of the subsea robot. In some embodiments, the subsea robot may be the subsea robots 3 described in FIGS. 2-3.

In some embodiments, a floatation device, such as a communication buoy, with one or more embedded over-the-air communication devices (e.g., wireless antenna, satellite reception equipment, or the like) may be deployed during the submerging process. In some implementations, the submersible launch vessel may maintain its position by dynamic station-keeping using an onboard propulsion system. In some embodiments, the submersible launch vessel may maintain its position at a location (either on water or underwater) using an anchoring mechanism that may be gravity-based or suction-based. The submersible launch vessel may also be connected to existing subsea infrastructure for power and communication. In other embodiments, the submersible launch vessel may be kept in-situ by a towing-vessel-holding station and positioning the towing apparatus of the towing-vessel-holding station as needed.

In block 404, the submersible launch vessel may receive power from a power source (e.g. battery pack or a battery bank, fuel cell, etc.) via a docking station of the submersible launch vessel and/or via a wired link to the submersible launch vessel. In some embodiments, the power source may be the power sources 202, 302 described in FIGS. 2-3.

In block 406, control and supervision data may be transmitted from onshore to offshore (to the submerged submersible launch vessel). A through-water communication device remains in communication with the subsea robot, relaying relevant control and supervision data to the subsea robot, and may be further used to determine and maintain the absolute and relative positions of the subsea robot. In some embodiments, through-water communication device may be through-water communication device 205, 305 described in FIGS. 2-3. One or more tasks/operations may be executed using the subsea robot with a level of human input from a control center dictated by the level of autonomy of the subsea robot. In some embodiments, the control center may be onshore control and supervision locations 100 of FIG. 1 or a floating vessel remotely located from the submersible launch vessel.

In block 408, video, audio, and telemetry data captured in the subsea environment before/after the submersible launch vessel submerges may be sent to an onshore control and supervision location. At all times the position of the subsea robot may be maintained relative to the position of the submersible launch vessel using, for example, one or more through-water communication devices.

In the case of self-propelled variations of the submersible launch vessels described herein, a submersible launch vessel may be autonomously or otherwise separately positioned and operated from a deployed subsea robot underwater to best execute required tasks and thereby maximize mission duration. This is an example of a shared autonomy between the subsea robot and the submersible launch vessel. Power may also be shared, controlled, or otherwise regulated between the submersible launch vessel and the subsea robot to best execute underwater tasks and maximize task durations. This is another example of a shared autonomy between the submersible launch vessel and the subsea robot.

FIGS. 5-11 show multiple optional aspects of the submersible launch vessel described herein.

Figure 5:
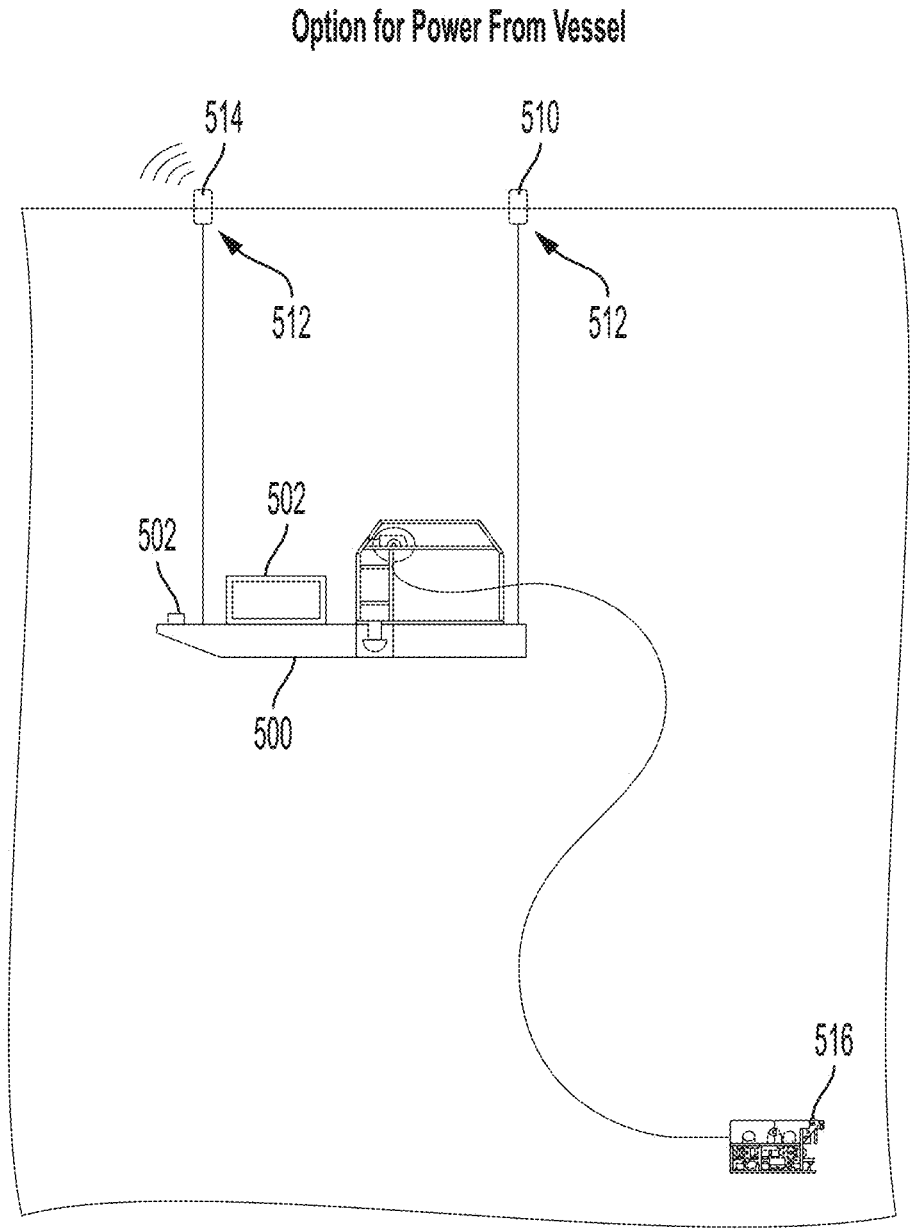
FIG. 5 is a schematic diagram illustrating a submersible launch vessel having a port for transmitting and/or receiving power from other vessels, in accordance with some embodiments.
Figure 6:
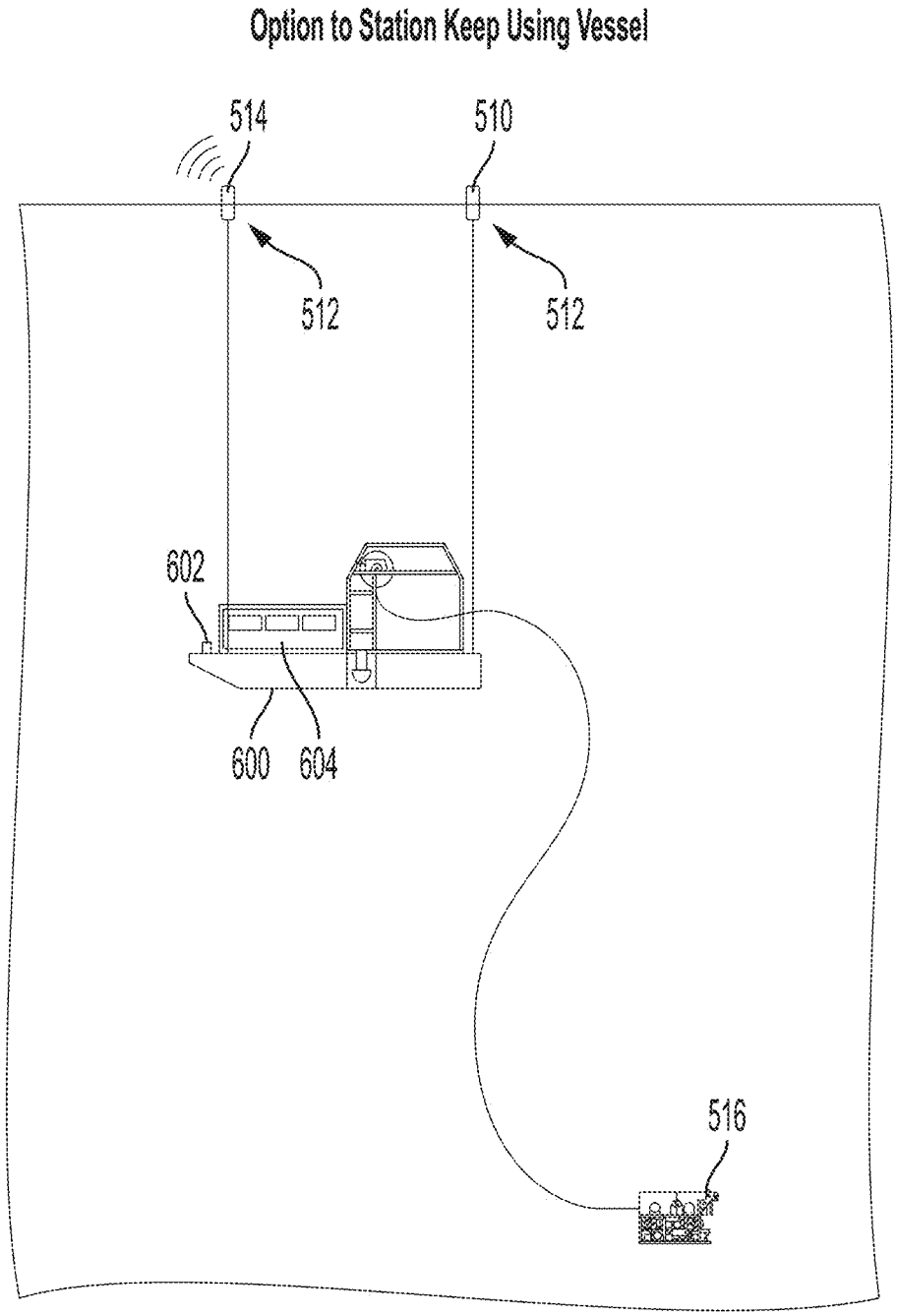
FIG. 6 is a schematic diagram illustrating a submersible launch vessel having a tow wire that allows other on-water or under-water vessels to tow the submersible launch vessel as needed, in accordance with some embodiments.

FIG. 5 is a schematic diagram illustrating a submersible launch vessel 500 having a port 502 for transmitting and/or receiving power from other vessels. FIG. 6 is a schematic diagram illustrating a submersible launch vessel 600 having a tow wire 602 that allows it to be towed as needed. Power source 604 may be used to power the submersible vessel 600.

Figure 7:
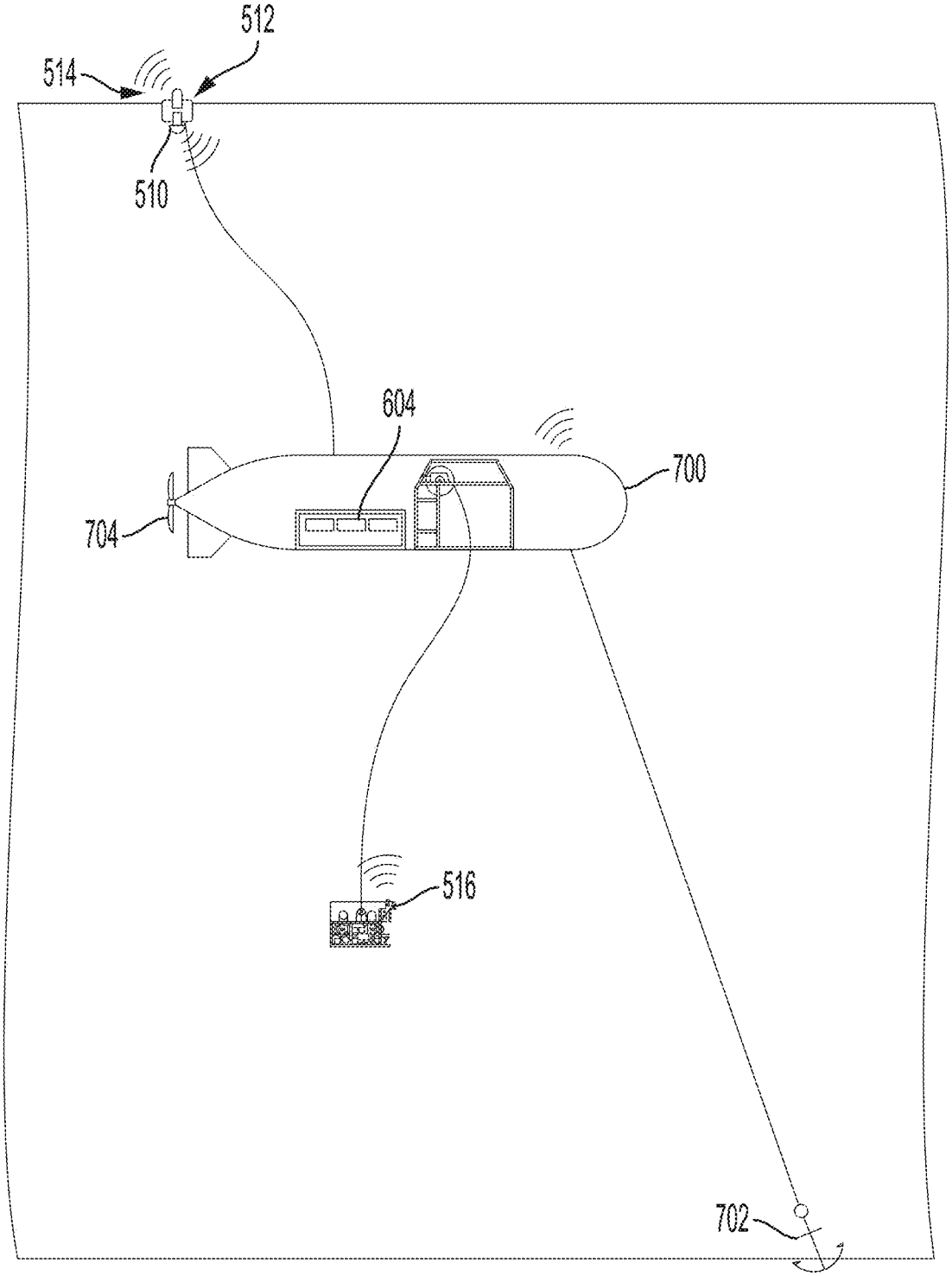
FIG. 7 is a schematic diagram illustrating a mooring aspect of a submersible launch vessel with one or more anchors attached to the submersible launch vessel, in accordance with some embodiments.
Figure 8:
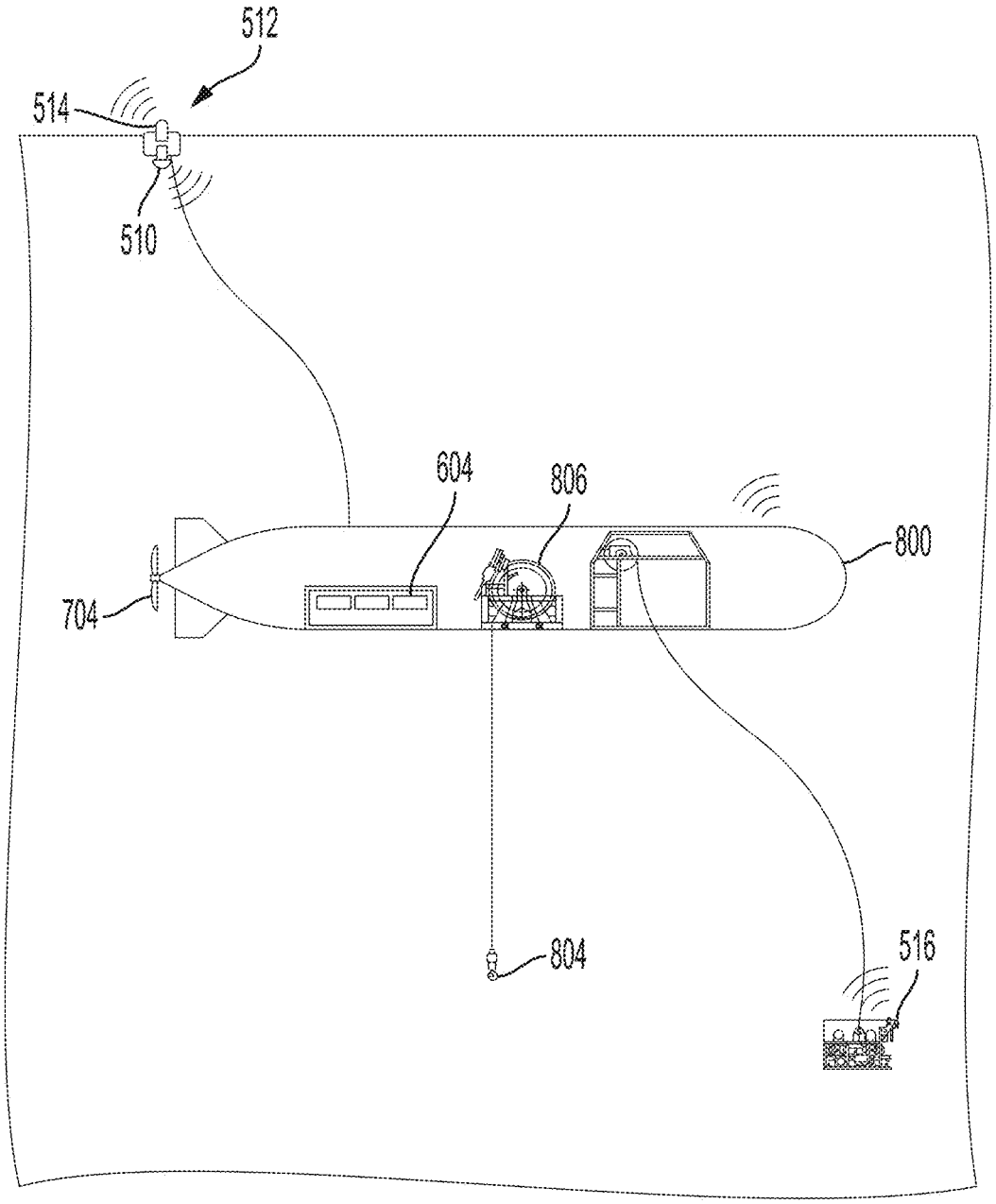
FIG. 8 is a schematic diagram illustrating a submersible launch vessel having a crane, in accordance with some embodiments.

FIG. 7 is a schematic diagram illustrating a mooring aspect of the submersible launch vessel 700 with one or more anchors 702 attached to the submersible launch vessel 700, in accordance with some embodiments. FIG. 8 is a schematic diagram illustrating a submersible launch vessel 800 having winch 806, in accordance with some embodiments. The submersible launch vessel 800 may include a subsea lifting line and hook arrangement 804 that cooperates with the winch 806 that allows it to recover large items/objects (e.g., objects weighing 0.1-3 tons) on top of water and/or underwater.

Figure 9:
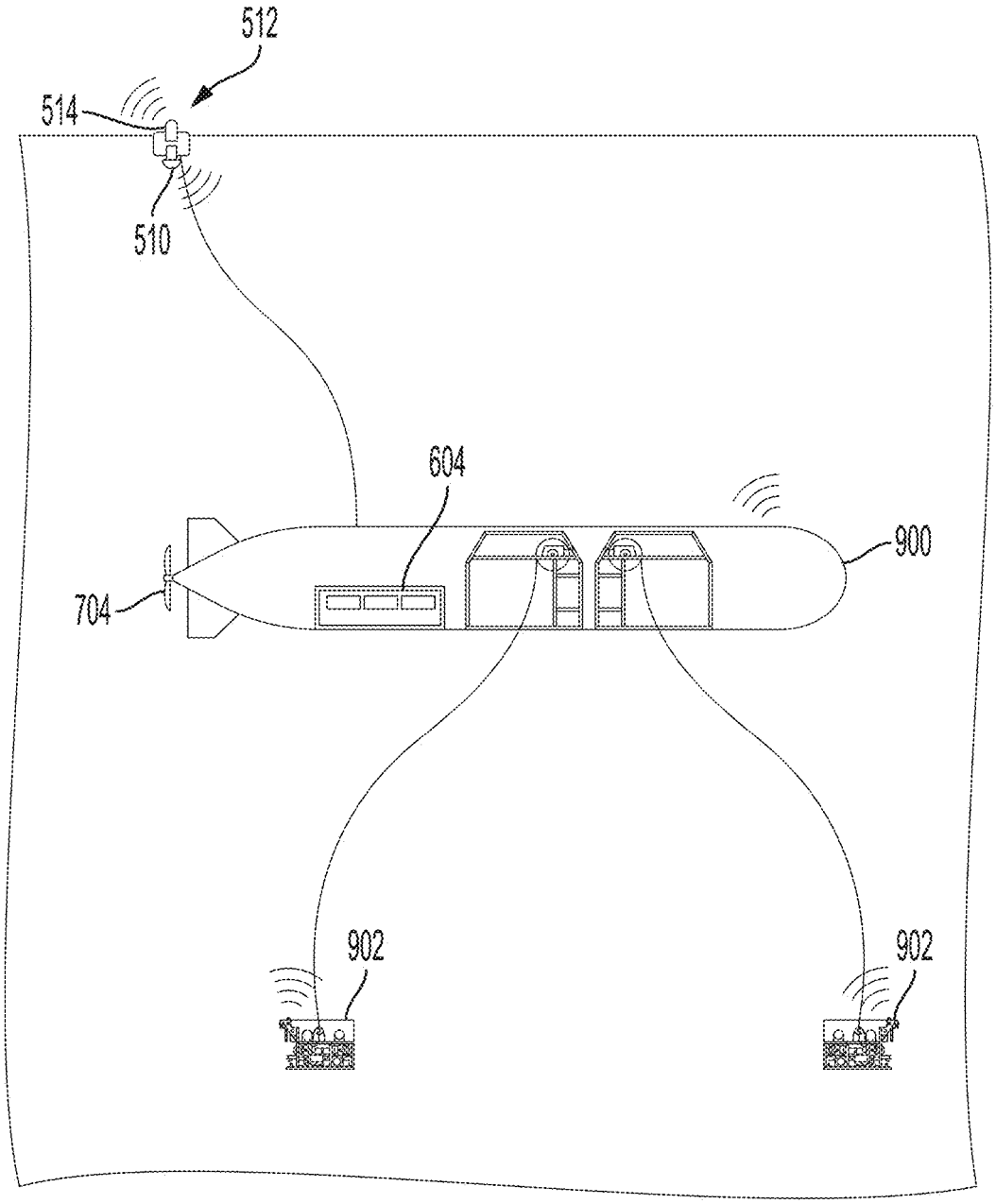
FIG. 9 is a schematic diagram illustrating a submersible launch vessel configured to include two or more robots that can be remotely operated independent of each other, in accordance with some embodiments.

FIG. 9 is a schematic diagram illustrating a submersible launch vessel 900 being configured to include two or more robots 902 that can be remotely operated independent of each other, in accordance with some embodiments.

Figure 10:
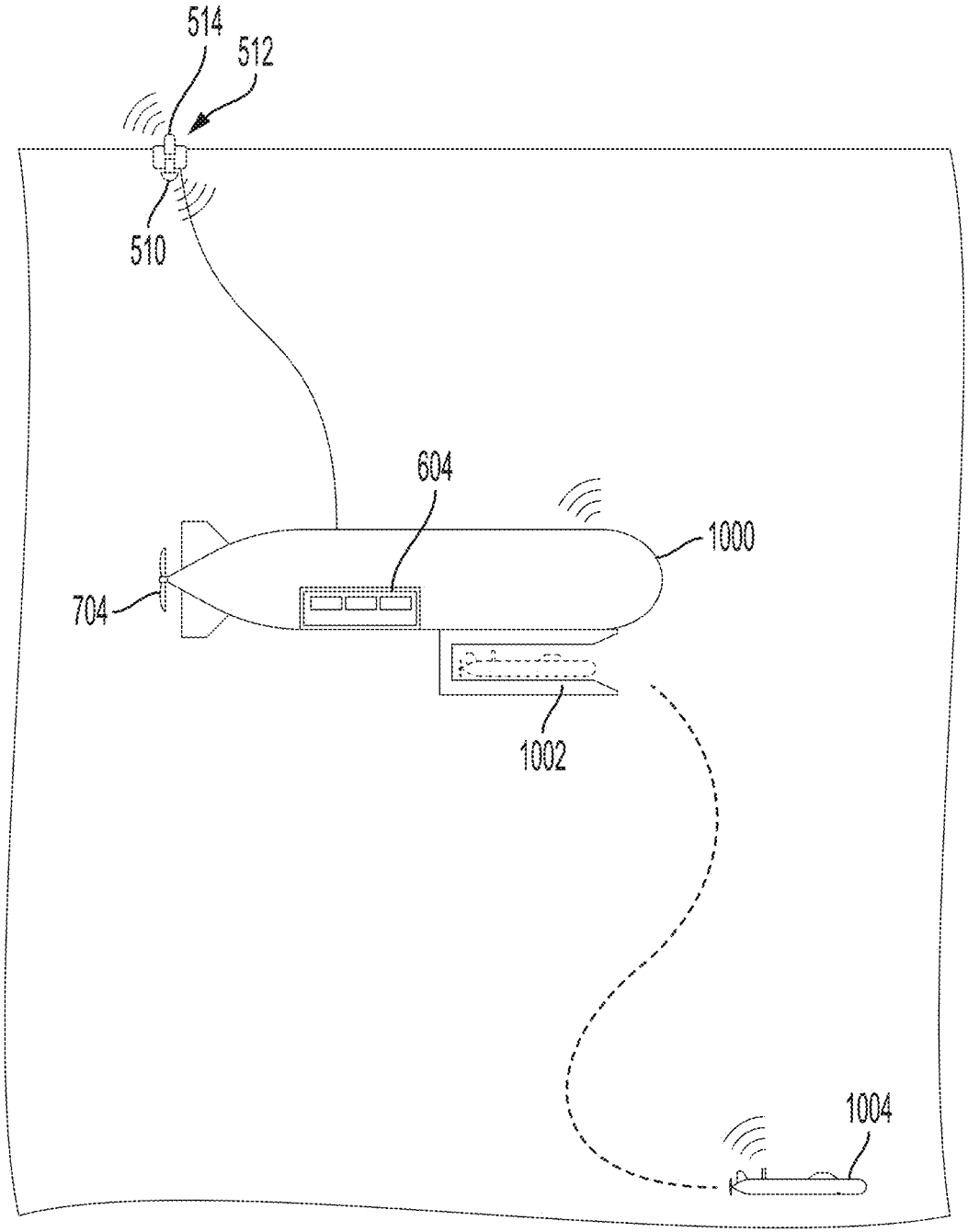
FIG. 10 is a schematic diagram illustrating a submersible launch vessel configured to include an autonomous underwater vehicle (AUV) dock, in accordance with some embodiments.

FIG. 10 is a schematic diagram illustrating a submersible launch vessel 1000 that may be configured to include an autonomous underwater vehicle (AUV) dock 1002 with charging and programming interfaces that allow for launching an AUV 1004 and performing recovery operations, in accordance with some embodiments.

Figure 11:
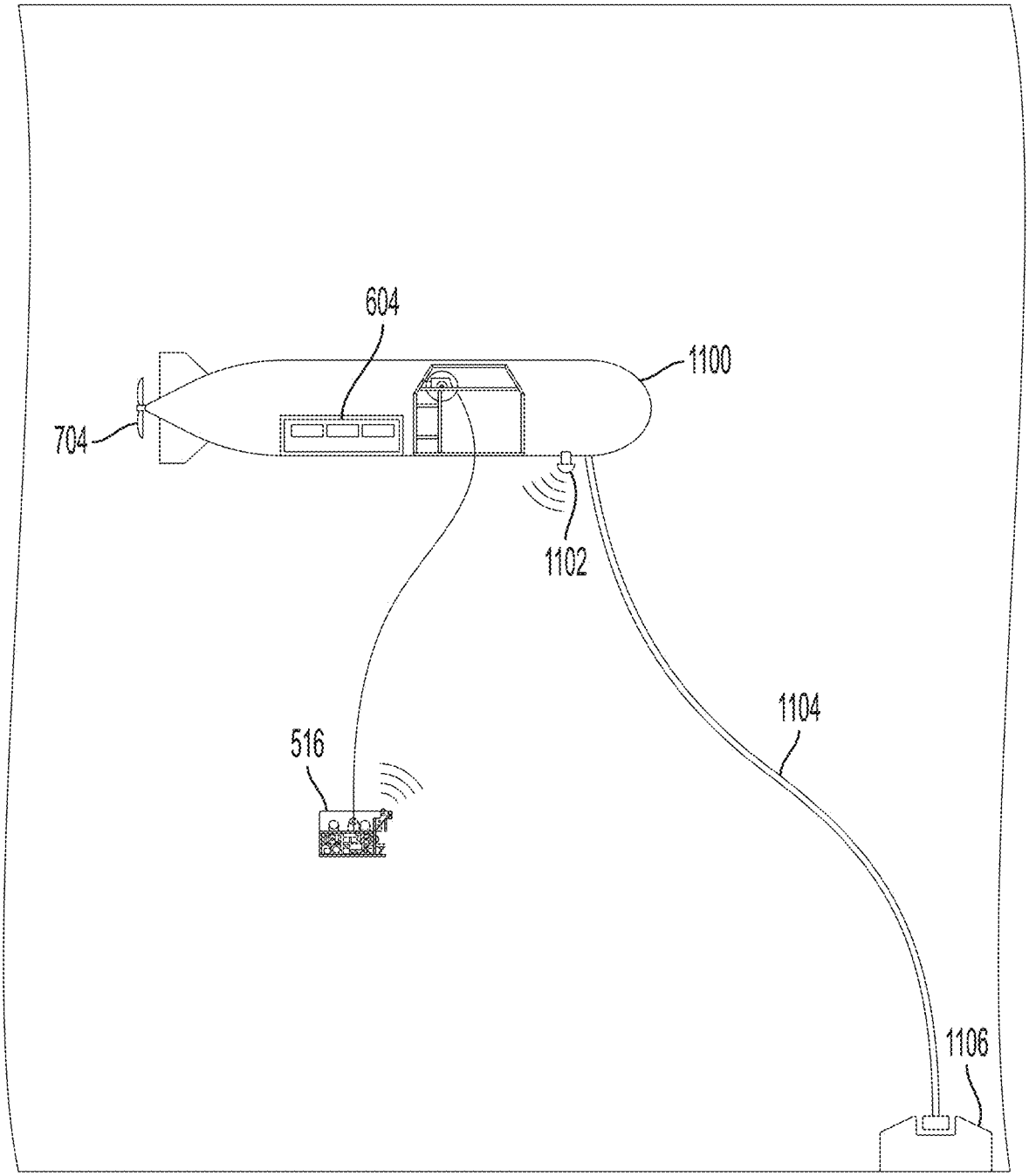
FIG. 11 is a schematic diagram illustrating a submersible launch vessel configured to include power and communication connection to existing subsea infrastructure, in accordance with some embodiments.

FIG. 11 is a schematic diagram illustrating a submersible launch vessel 1100 that may be configured to include power and communication connection to existing subsea infrastructure, in accordance with some embodiments. The submersible launch vessel 1100 is similar to submersible launch vessel 700. The difference is a through-water communication device 1102 may be connected to submersible launch vessel 1100, and submersible launch vessel 1100 may be connected to a seabed hosted power and communication connection 1104 to existing subsea infrastructure 1106.

It is appreciated that these aspects and configurations of each of the submersible launch vessels 500, 600, 700, 800, 900, 1000 and 1100 may include a through-water communication device 510 that may be configured for acoustic tracking and communication of robots and AUVs associated with each of the submersible launch vessels 500, 600, 700, 800, 900, 1000 and 1100. It is further appreciated that embodiments of the submersible launch vessels 500, 600, 700, 800, 900, and 1000 may include one or more floatation devices 512 that may embed one or more over-the-air communication devices 514 that stay in communication with one or more onshore control and supervision locations as the submersible launch vessels 500, 600, 700, 800, 900, and 1000 and equipment thereon are operated.

In all aspects shown in FIGS. 5-11, the submersible launch vessels 500, 600, 700, 800, 900, 1000 and 1100 may be towed to the worksite, may be connected to a ship/boat that travels to the worksite, or may utilize an onboard propulsion and navigation system 704 that drives it to the worksite.

In some embodiments, the onboard propulsion and navigation system used by submersible launch vessels 500, 600, 700, 800, 900, 1000 and 1100 may be manned or unmanned depending on the implementation. In addition, the onshore control and supervision locations 100 with which submersible launch vessels 500, 600, 700, 800, 900, 1000 and 1100 communicate may be local or remote relative to the submersible launch vessel. In some embodiments, the onshore control and supervision locations 100 may be a single location or a distributed location and may further have configurations that may be manually/collaboratively operated. The submersible launch vessels 500, 600, 700, 800, 900, 1000 and 1100 may have variable levels of autonomy ranging from user in the loop supervised control to full autonomy. The level of autonomy (i.e. how much supervised control and how much autonomous control) may change depending on the concept of operations (ConOps) or throughout the mission depending on the specific objective.

In addition to the previously discussed energy sources from which the power source derives energy, it is further appreciated that the power sources 604 of submersible launch vessels 600, 700, 800, 900, 1000 and 1100 may be topped up or otherwise regenerated using secondary energy sources such as power generators on vessels (e.g., passing vessels) in the vicinity of the submersible launch vessel using techniques such as fast-charging or trickle-charging as the case may be. In some embodiments, an onboard power generator situated on/or in close proximity to submersible launch vessels 500, 600, 700, 800, 900, 1000 and 1100 may also fast-charge or trickle-charge the large power source of the submersible launch vessels 500, 600, 700, 800, 900, 1000 and 1100. This charge power could also come from existing subsea infrastructure. In some embodiments, the submersible launch vessels 500, 600, 700, 800, 900, 1000 and 1100 may have multiple subsea robots (e.g., multiple AUVs and/or multiple ROVs).

Figure 12A:
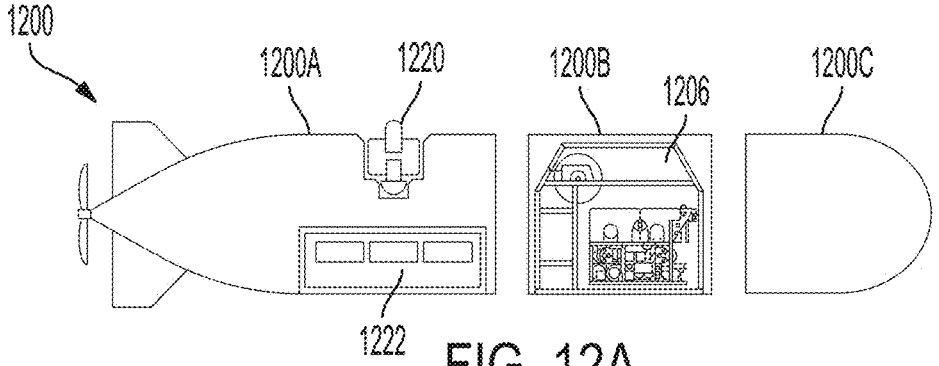
FIGS. 12A-12D are schematic diagrams illustrating various modular arrangements of submersible launch vessels, in accordance with some embodiments.

FIGS. 12A-12D are schematic diagrams illustrating various modular arrangements of a submersible launch vessel 1200, 1202, 1204 and 1206, in accordance with some embodiments. FIG. 12A shows a modular submersible launch vessel 1200 having modular components 1200A, 1200B, and 1200C, in accordance with some embodiments. Modular component 1200A may be sufficiently sized to house an over-the-air communication device 1220 and a power source 1222. Modular component 1200B may be sufficiently sized to house a robot 1206. The modular components 1200A, 1200B, and 1200C may be connected together to form a sufficiently strong water seal for submersible launch vessel 1200.

Figure 12B:
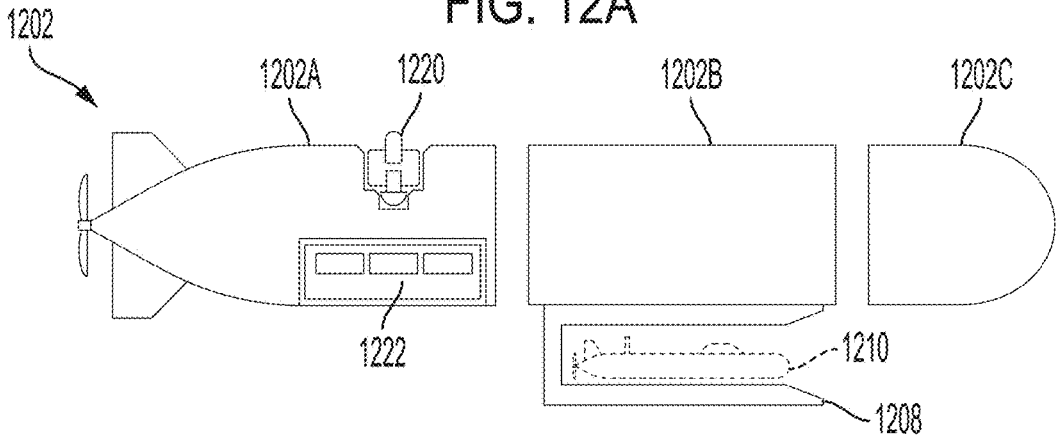

FIG. 12B shows a modular submersible launch vessel 1202 having modular components 1202A, 1202B, and 1202C. Modular component 1202A may be sufficiently sized to house an over-the-air communication device 1220 and a power source 1222. Modular component 1202B may be attached to a launch system 1208 for an AUV 1210. The modular components 1202A, 1202B, and 1202C may be connected together to form a sufficiently strong water seal for submersible launch vessel 1202.

Figure 12C:
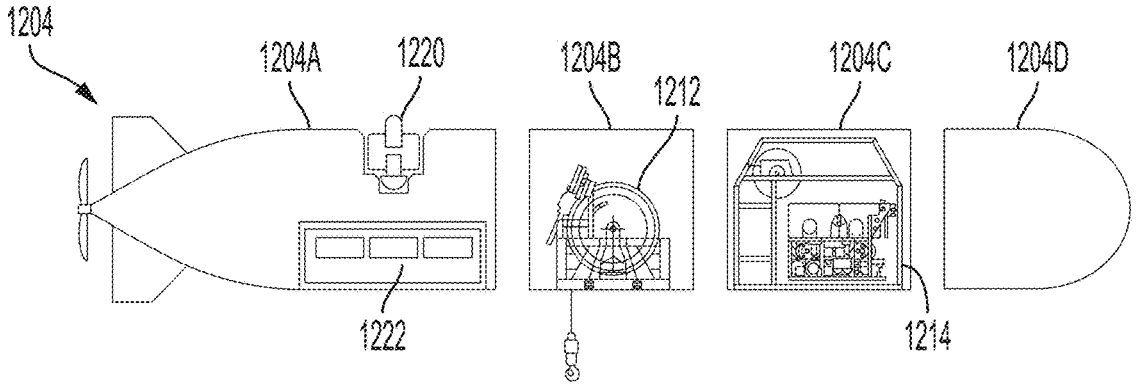

FIG. 12C shows a modular submersible launch vessel 1204 having modular components 1204A, 1204B, 1204C, and 1204D. Modular component 1204A may be sufficiently sized to house an over-the-air communication device 1220 and a power source 1222. Modular component 1204B may be sufficiently sized to house a crane system 1212, which is similar to crane system 806. Modular component 1204C may be sufficiently sized to house a robot 1214. The modular components 1204A, 1204B, 1204C and 1204D may be connected together to form a sufficiently strong water seal for submersible launch vessel 1204.

Figure 12D:
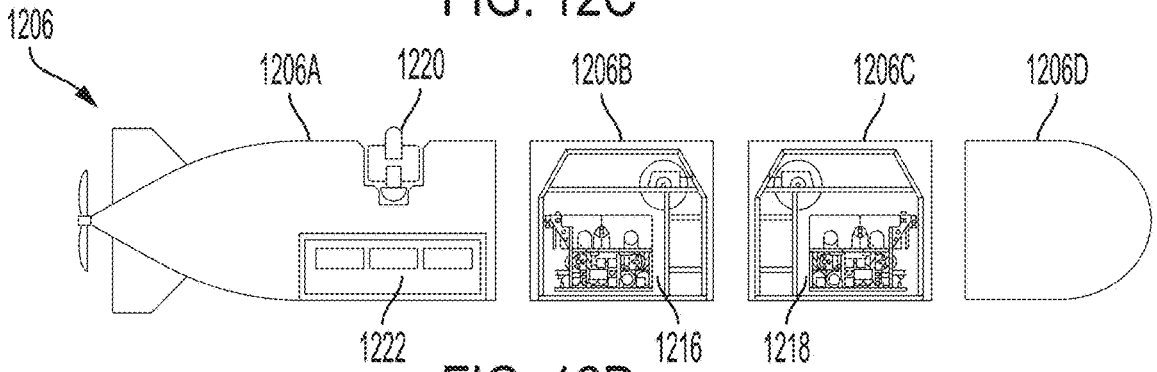

FIG. 12D shows a modular submersible launch vessel 1206 having modular components 1206A, 1206B, 1206C, and 1206D. Modular component 1206A may be sufficiently sized to house an over-the-air communication device 1220 and a power source 1222. Modular component 1206B may be sufficiently sized to house a first robot 1216. Modular component 1206C may be sufficiently sized to house a second robot 1218. The modular components 1206A, 1206B, 1206C and 1206D may be connected together to form a sufficiently strong water seal for submersible launch vessel 1206.

Through coordination of the submersible launch vessels and the subsea robot(s) described herein, these platforms may be enabled to perform dynamic decision making to execute an instruction received from a mission controller at the control center. The shared autonomy between the submersible launch vessels and subsea robot(s) allows for the efficient performance of a variety of subsea tasks that can be assigned by mission controllers in a diverse setting of control centers. As discussed above, the mission controller can be human, or it can be a machine.

In some embodiments, the submersible launch vessels described herein and one or more deployable systems, such as the robots and AUVs described herein, may collaborate autonomously to execute one or more instructions from the mission controller. In some embodiments, the submersible launch vessels and one or more deployable systems may use a goal-based, shared mission plan that defines tasks as opposed to waypoints. In some embodiments, the submersible launch vessels and the one or more deployable systems may use a distributed world model to share perceived information about the world in both physical (video/sonar/lidar/etc.) and mission (goal status, change detection, etc.) terms. In some embodiments, the submersible launch vessels and the one or more deployable systems may use machine learning to optimize mission execution at runtime to ensure reactive and efficient operations. In some embodiments, the one or more deployable systems and the mission controller may employ an autonomy system that supports a range of autonomy levels from a user in a loop supervised control to a fully autonomous operation. In some embodiments, the threshold between supervised control and full autonomy is dynamic and may change throughout the mission to easily enable manual intervention where user input is required and full autonomy when it isn't.

In some embodiments, the submersible launch system may share a world model allowing the submersible launch vessel and the one or more deployable systems to collaborate autonomously. In some embodiments, the model may include seabed topography data, wave and tide data, surface wind data, positions of subsea structures, positions of delivery vehicle and subsea robot(s), and the modelled locations of any tethers between the systems and the operational cone of any wireless communication modems. In some embodiments, the world model may be fused with sensor data to allow a vehicle to optimize mission profile for operational reasons. For example, a delivery vehicle moves to the optimal position to manage tether and buoy location in order to get the subsea robot to the work location. Another example may be adjusting a delivery vehicle for efficient station keeping in high subsea current and to remain below wave base for enhanced bollard pull performance to react to drag from tethers and buoy, in combination with compensating for movement of the buoy's swing circle relative to structures.

In some embodiments, the submersible launch vessels described herein may maintain the position of the communication devices, such as the over-the-air communication devices or through-water communication devices described herein, in order to optimize length and the effect of drag on the tether to the surface device. In some embodiments, position control may be achieved by varying tether length paid out from the submersible launch system. This may be additionally coupled with a secondary mid-water float to reduce lateral excursion from the submersible launch system, and/or one or more thrusters on the surface device.

In some embodiments, position control may be also influenced by the depth and position of the submersible launch system in the water column. In some embodiments, smart decisions may be made by the submersible launch system to position the communication devices in a dynamic way during operations based on the amount of tether paid out from the submersible launch system, environmental data, proximity to structures, and marine traffic positions. In some embodiments, data may be gathered and passed to the submersible launch system for consideration from a range of sources. The sources may include, the submersible launch system (pre-installed data giving reference geometric data on the worksite or onboard sensors for live data), the communication devices (live sensor data), or received data via satellite communication to a communication device (live data or updates to pre-installed data).

In some embodiments, the submersible launch systems described herein may share power among system components and use machine learning to accurately predict load requirements based on environmental and mission conditions and dynamically adjust the mission profile to maximize range endurance. An example of optimizing power usage might be for a subsea robot to return to the delivery craft before making a large transit to the other side of a subsea target, rather than the two vehicles each making the transit side-by-side. In some embodiments, the initial training datasets for the machine learning (ML) algorithms may come from full environmental simulations, and may be augmented as real mission data. In some embodiments, intelligent power management may include the switching of energy delivery between assets to smooth peak loads and optimizing charge profiles.

The present disclosure is particularly advantageous because it provides cost-savings by removing the need for large, complex offshore support vessels which are usually manned by large onboard crews. Other benefits provided by the methods and systems presented in this disclosure include an increased accessibility and sustainability of subsea work through a reduction in lead times (e.g., the time between the initiation and completion of a production process and/or a subsea task), a reduction in CO2 emissions by subsea equipment that derive power from fossil fuels, and an overall cost reduction associated with subsea work. The personnel (e.g., engineers, managers, technicians, scientists) operating the systems and methods disclosed are also shielded from hazardous subsea operating conditions due to their remotely operating the systems presented herein.

It is appreciated that the systems and methods disclosed have applications in aquaculture, marine science, subsea exploration, oil and gas production from oceanic sources as well as other offshore renewable energy generation processes, mineral harvesting and ocean restoration.

Reference in the specification to "one implementation" or "an implementation" means that a particular feature, structure, or characteristic described in connection with the implementation is included in at least one implementation of the disclosure. The appearances of the phrase "in one implementation," "in some implementations," "in one instance," "in some instances," "in one case," "in some cases," "in one embodiment," or "in some embodiments" in various places in the specification are not necessarily all referring to the same implementation or embodiment.

Finally, the above descriptions of the implementations of the present disclosure have been presented for the purposes of illustration and description. It is not intended to be exhaustive or to limit the present disclosure to the precise form disclosed. Many modifications and variations are possible in light of the above teaching. It is intended that the scope of the present disclosure be limited not by this detailed description, but rather by the claims of this application. As will be understood by those familiar with the art, the present disclosure may be embodied in other specific forms without departing from the spirit or essential characteristics thereof. Accordingly, the present disclosure is intended to be illustrative, but not limiting, of the scope of the present disclosure, which is set forth in the following claims.

What is claimed is:

1. A method of operating a submersible system, the method comprising:

receiving instructions from a mission controller via at least a first communication device to a submersible launch vessel to deploy one or more deployable systems of the submersible launch vessel for one or more underwater operations, wherein:

the submersible launch vessel is submerged within a waterbody, the submersible launch vessel includes a submersible power supply that powers the submersible launch vessel and the one or more deployable systems; and the submersible launch vessel includes one or more second communication devices in communication with the at least first communication device, the at least first communication device staying afloat while the submersible launch vessel remaining submerged in order to communicate with the mission controller;

remote controlling, via the one or more second communication devices coupled to the submersible launch vessel and the at least first communication device, the one or more deployable systems by the mission controller to execute the one or more underwater operations;

transmitting information associated with the one or more underwater operations including telemetry data to the mission controller from the submersible launch vessel via the at least first communication device; and maintaining positions of the one or more second communication devices in order to optimize length and the effect of drag on a tether to a surface device.

2. The method of claim 1, wherein receiving instructions from a mission controller comprises receiving instructions from a plurality of mission controllers within a plurality of distributed control locations that are located remotely or locally relative to the submersible launch vessel.

3. The method of claim 1, wherein receiving instructions from a mission controller comprises utilizing the at least first communication to be an over-the-air communication device.

4. A method of operating a submersible system, the method comprising:

receiving instructions from a mission controller via at least a first communication device to a submersible launch vessel to deploy one or more deployable systems of the submersible launch vessel for one or more underwater operations, wherein:

the submersible launch vessel is submerged within a waterbody, the submersible launch vessel includes a submersible power supply that powers the submersible launch vessel and the one or more deployable systems; and the submersible launch vessel includes one or more second communication devices in communication with the at least first communication device, the at least first communication device staying afloat while the submersible launch vessel remaining submerged in order to communicate with the mission controller;

remote controlling, via the one or more second communication devices coupled to the submersible launch vessel and the at least first communication device, the one or more deployable systems by the mission controller to execute the one or more underwater operations;

transmitting information associated with the one or more underwater operations including telemetry data to the mission controller from the submersible launch vessel via the at least first communication device; and sharing power among system components and using machine learning to accurately predict load requirements based on environmental and mission conditions and dynamically adjust a mission profile to maximize range endurance.

5. The method of claim 4, wherein receiving instructions from a mission controller comprises receiving instructions from a plurality of mission controllers within a plurality of distributed control locations that are located remotely or locally relative to the submersible launch vessel.

6. The method of claim 4, wherein receiving instructions from a mission controller comprises utilizing the at least first communication to be an over-the-air communication device.

7. A method of operating a submersible system, the method comprising:

receiving instructions from a mission controller via at least a first communication device to a submersible launch vessel to deploy one or more deployable systems of the submersible launch vessel for one or more underwater operations, wherein:

the submersible launch vessel is submerged within a waterbody, the submersible launch vessel includes a submersible power supply that powers the submersible launch vessel and the one or more deployable systems; and the submersible launch vessel includes one or more second communication devices in communication with the at least first communication device, the at least first communication device staying afloat while the submersible launch vessel remaining submerged in order to communicate with the mission controller;

remote controlling, via the one or more second communication devices coupled to the submersible launch vessel and the at least first communication device, the one or more deployable systems by the mission controller to execute the one or more underwater operations, wherein remote controlling the one or more deployable systems comprises collaborating autonomously to execute one or more instructions from the mission controller; and wherein collaborating autonomously comprises employing an autonomy system that supports a range of autonomy levels from a user in a loop supervised control to a fully autonomous operation; and transmitting information associated with the one or more underwater operations including telemetry data to the mission controller from the submersible launch vessel via the at least first communication device.

8. The method of claim 7, wherein the one or more deployable systems comprise one or more robots or autonomous underwater vehicles.

9. The method of claim 7, wherein receiving instructions from a mission controller comprises receiving instructions from a plurality of mission controllers within a plurality of distributed control locations that are located remotely or locally relative to the submersible launch vessel.

10. The method of claim 7, wherein receiving instructions from a mission controller comprises utilizing the at least first communication to be an over-the-air communication device.

11. A method of operating a submersible system, the method comprising:

receiving instructions from a mission controller via at least a first communication device to a submersible launch vessel to deploy one or more deployable systems of the submersible launch vessel for one or more underwater operations, wherein:

the submersible launch vessel is submerged within a waterbody, the submersible launch vessel includes a submersible power supply that powers the submersible launch vessel and the one or more deployable systems; and the submersible launch vessel includes one or more second communication devices in communication with the at least first communication device, the at least first communication device staying afloat while the submersible launch vessel remaining submerged in order to communicate with the mission controller;

remote controlling, via the one or more second communication devices coupled to the submersible launch vessel and the at least first communication device, the one or more deployable systems by the mission controller to execute the one or more underwater operations, wherein remote controlling the one or more deployable systems comprises collaborating autonomously to execute one or more instructions from the mission controller; and wherein collaborating autonomously comprises sharing a world model between the submersible launch vessel and the one or more deployable systems; and transmitting information associated with the one or more underwater operations including telemetry data to the mission controller from the submersible launch vessel.

12. The method of claim 11, wherein the world model includes seabed topography data, wave and tide data, surface wind data, positions of subsea structures, positions of delivery vehicles and the one or more deployable systems, or modelled locations of any tethers between the submersible launch system and the operational cone of any of the one or more communication devices.

13. The method of claim 11, wherein receiving instructions from a mission controller comprises receiving instructions from a plurality of mission controllers within a plurality of distributed control locations that are located remotely or locally relative to the submersible launch vessel.

14. The method of claim 11, wherein receiving instructions from a mission controller comprises utilizing the at least first communication to be an over-the-air communication device.

15. A submersible system comprising:

a submersible launch vessel that sends instructions via at least a first communication device to a submersible launch vessel to deploy one or more deployable systems for one or more underwater operations, wherein the submersible launch vessel is submerged within a waterbody;

a submersible power supply that powers the submersible launch vessel and the one or more deployable systems; and one or more second communication devices in communication with a mission controller via the at least one first communication device, the at least first communication device staying afloat while the submersible launch vessel remaining submerged in order to communicate with the mission controller, wherein the one or more deployable systems, via the one or more second communication devices and the at least first communication device, coupled to the submersible launch vessel, are remote controlled by the mission controller to execute the one or more underwater operations, wherein information associated with the one or more underwater operations including telemetry data is transmitted to the mission controller from the submersible launch vessel via the at least first communication device, and wherein the submersible launch system maintains positions of the one or more second communication devices in order to optimize length and the effect of drag on a tether to a surface device.

16. The submersible system of claim 15, wherein the mission controller comprises a plurality of mission controllers within a plurality of distributed control locations that are located remotely or locally relative to the submersible launch vessel.

17. The submersible system of claim 15, wherein the at least first communication comprises at least one over-the-air communication device.

18. A submersible system comprising:

a submersible launch vessel that sends instructions via at least a first communication device to a submersible launch vessel to deploy one or more deployable systems for one or more underwater operations, wherein the submersible launch vessel is submerged within a waterbody;

a submersible power supply that powers the submersible launch vessel and the one or more deployable systems; and one or more second communication devices in communication with a mission controller via the at least one first communication device, the at least first communication device staying afloat while the submersible launch vessel remaining submerged in order to communicate with the mission controller, wherein the one or more deployable systems, via the one or more second communication devices and the at least first communication device, coupled to the submersible launch vessel, are remote controlled by the mission controller to execute the one or more underwater operations, wherein information associated with the one or more underwater operations including telemetry data is transmitted to the mission controller from the submersible launch vessel via the at least first communication device, wherein the submersible launch system shares power among system components and uses machine learning to accurately predict load requirements based on environmental and mission conditions and dynamically adjusts a mission profile to maximize range endurance.

19. The submersible system of claim 18, wherein the mission controller comprises a plurality of mission controllers within a plurality of distributed control locations that are located remotely or locally relative to the submersible launch vessel.

20. The submersible system of claim 18, wherein the at least first communication comprises at least one over-the-air communication device.

21. A submersible system comprising:

a submersible launch vessel that sends instructions via at least a first communication device to a submersible launch vessel to deploy one or more deployable systems for one or more underwater operations, wherein the submersible launch vessel is submerged within a waterbody;

a submersible power supply that powers the submersible launch vessel and the one or more deployable systems; and one or more second communication devices in communication with a mission controller via the at least one first communication device, the at least first communication device staying afloat while the submersible launch vessel remaining submerged in order to communicate with the mission controller, wherein the one or more deployable systems, via the one or more second communication devices and the at least first communication device, coupled to the submersible launch vessel, are remote controlled by the mission controller to execute the one or more underwater operations, wherein information associated with the one or more underwater operations including telemetry data is transmitted to the mission controller from the submersible launch vessel, wherein the submersible launch vessel and the one or more deployable systems collaborate autonomously to execute one or more instructions from the mission controller, and wherein the one or more deployable systems and the mission controller employ an autonomy system that supports a range of autonomy levels from a user in a loop supervised control to a fully autonomous operation.

22. The submersible system of claim 21, wherein the one or more deployable systems comprise one or more robots or autonomous underwater vehicles.

23. The submersible system of claim 21, wherein the mission controller comprises a plurality of mission controllers within a plurality of distributed control locations that are located remotely or locally relative to the submersible launch vessel.

24. The submersible system of claim 21, wherein the at least first communication device comprises at least one over-the-air communication device.

25. A submersible system comprising:

a submersible launch vessel that sends instructions via at least a first communication device to a submersible launch vessel to deploy one or more deployable systems for one or more underwater operations, wherein the submersible launch vessel is submerged within a waterbody;

a submersible power supply that powers the submersible launch vessel and the one or more deployable systems; and one or more second communication devices in communication with a mission controller via the at least first communication device, the at least first communication device staying afloat while the submersible launch vessel remaining submerged in order to communicate with the mission controller, wherein the one or more deployable systems, via the one or more second communication devices and the at least first communication device, coupled to the submersible launch vessel, are remote controlled by the mission controller to execute the one or more underwater operations, wherein information associated with the one or more underwater operations including telemetry data is transmitted to the mission controller from the submersible launch vessel via the at least first communication device, wherein the submersible launch vessel and the one or more deployable systems collaborate autonomously to execute one or more instructions from the mission controller, and wherein the submersible launch system shares a world model allowing the submersible launch vessel and the one or more deployable systems to collaborate autonomously.

26. The submersible system of claim 25, wherein the world model includes seabed topography data, wave and tide data, surface wind data, positions of subsea structures, positions of delivery vehicle and subsea robot(s), or modelled locations of any tethers between the submersible launch system and the operational cone of any of the one or more communication devices.

27. The submersible system of claim 25, wherein the mission controller comprises a plurality of mission controllers within a plurality of distributed control locations that are located remotely or locally relative to the submersible launch vessel.

28. The submersible system of claim 25, wherein the at least first communication device comprises at least one over-the-air communication device.

29. A submersible system comprising:

a submersible launch vessel that sends instructions via at least a first communication device to a submersible launch vessel to deploy one or more deployable systems for one or more underwater operations, wherein the submersible launch vessel is submerged within a waterbody;

a submersible power supply that powers the submersible launch vessel and the one or more deployable systems; and one or more second communication devices in communication with a mission controller via the at least first communication device, the at least first communication device staying afloat while the submersible launch vessel remaining submerged in order to communicate with the mission controller, wherein the submersible launch vessel and the one or more deployable systems use machine learning to optimize mission execution.

30. The submersible system of claim 29, wherein the one or more deployable systems and the mission controller employ an autonomy system that supports a range of autonomy levels depending on the one or more underwater operations.

31. The submersible system of claim 29, wherein the at least first communication device comprises at least one over-the-air communication device.

* * * * *